United States Patent [19]

Howk

[11] 4,036,525

[45] July 19, 1977

[54] BACKREST ADJUSTMENT MECHANISM

[75] Inventor: Victor G. Howk, Sturgis, Mich.

[73] Assignee: GF Business Equipment, Inc., Youngstown, Ohio

[21] Appl. No.: 674,959

[22] Filed: Apr. 8, 1976

[51] Int. Cl.[2] ..... A47C 1/00

[52] U.S. Cl. ..... 297/353; 248/408; 403/106; 403/325

[58] Field of Search ..... 297/296–301, 297/353, 410; 248/157, 161, 188.2, 188.5, 407–409, 423; 108/146; 403/106, 107, 109, 322, 325, 350; 292/267, 274, 278

[56] References Cited

U.S. PATENT DOCUMENTS

| | | | |
|---|---|---|---|
| 848,001 | 3/1907 | Berninghaus | 297/410 X |
| 3,309,050 | 3/1967 | Blink et al. | 108/146 X |
| 3,326,602 | 6/1967 | Moore et al. | 297/353 |
| 3,460,794 | 8/1969 | Colautti | 248/423 X |
| 3,854,772 | 12/1974 | Abrahamson et al. | 297/353 |

FOREIGN PATENT DOCUMENTS

| | | | |
|---|---|---|---|
| 885,214 | 8/1953 | Germany | 292/267 |
| 270,408 | 7/1913 | Germany | 297/410 |
| 1,371,641 | 10/1974 | United Kingdom | 297/353 |
| 11,244 | 6/1890 | United Kingdom | 292/267 |

*Primary Examiner*—Roy D. Frazier
*Assistant Examiner*—William E. Lyddane
*Attorney, Agent, or Firm*—Emory L. Groff, Jr.

[57] ABSTRACT

A chair rest member supported upon a back post includes a spring-urged laterally shiftable lever journalled within a housing carried by the rest member. A cutout in the back post includes a plurality of vertically spaced lock recesses selectively engageable by an offset catch on the lever to fixedly retain the rest member at a selected elevation.

9 Claims, 4 Drawing Figures

BACKREST ADJUSTMENT MECHANISM

This invention relates generally to furniture articles, and more particularly, to a chair having an improved backrest adjustment mechanism.

It is well known to provide office furniture, especially secretarial chairs, with a backrest member capable of being vertically adjusted in a ready manner in order to accommodate the varying physical configuration of individual users. A chair backrest is intended to provide support to a user's back in the area between the shoulder blades and waist and even two users of identical physical stature may prefer a different vertical positioning of the same chair backrest to satisfy their particular desire. Accordingly, by the present invention, an improved body support member is provided having unique means allowing of ready vertical adjustment thereof with respect to the remainder of the chair article, which adjustment is accomplished without the need for any external tools and requires no more than a second or two to accomplish.

Accordingly, one of the primary objects of the present invention is to provide an improved adjustable chair rest member mounted upon relatively fixed upright support means and including a mounting and adjustment assembly permitting of relative vertical displacement therebetween, which displacement is achieved by the simple manipulation of an actuating lever.

A further object of the present invention is to provide an improved adjustable chair rest member attached to an upright support member by means of an adjustment assembly including a laterally displaceable actuating lever having integral catch means engageable with a selected one of a plurality of lock means provided in the upright support member.

Another object of the present invention is to provide an improved backrest adjustment mechanism including a laterally displaceable actuating lever having a circular bearing portion journalled within a mating cutout section provided in a retainer plate, and which is normally spring-urged into a locking position engaging a selected one of a plurality of recesses in an upright support member.

Still another object of the present invention is to provide an improved backrest adjustment mechanism including a housing containing an upright support member and a retainer plate sandwiched therebetween with a laterally pivotal actuating lever journalled within a cutout provided in the retainer plate and serving to lock the housing and its attached backrest to the upright support member in a selected one of a plurality of vertically aligned recesses provided therein.

With these and other objects in view which will more readily appear as the nature of the invention is better understood, the present invention consists in the novel construction, combination and arrangement of parts hereinafter more fully described, illustrated and claimed.

A preferred and practical embodiment of the invention is shown in the accompanying drawings, in which.

Similar reference characters designate corresponding parts throughout the several figures of the drawings.

Figure 1:
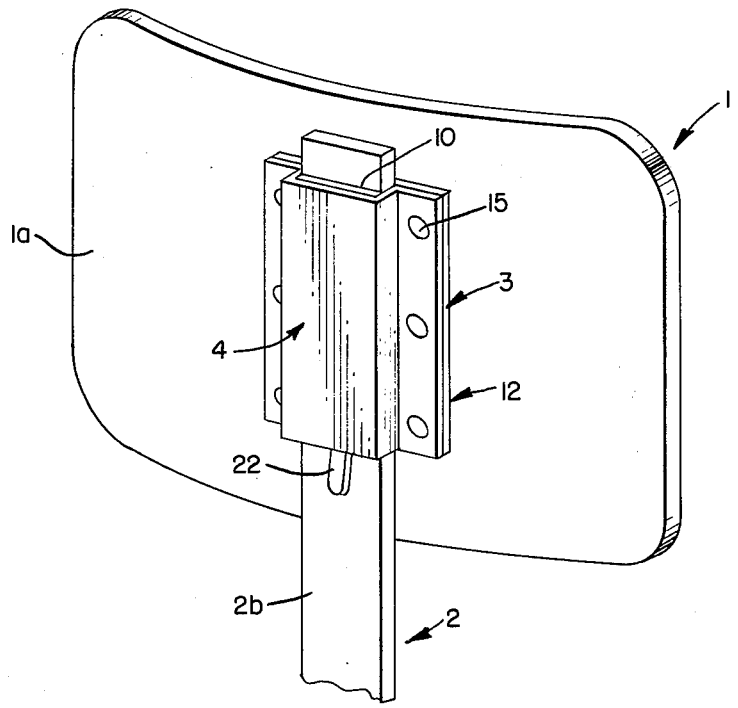
FIG. 1 is a rear perspective view illustrating the backrest adjustment mechanism of the present invention.

Referring now to the drawings, particularly FIG. 1, the adjustment mechanism of the present invention will be seen to be illustrated in combination with a backrest, generally designated 1, attached to a normally stationary upright support member in the form of the back post 2. Although the rest member 1 is shown in the form of a backrest as commonly employed in swivel chairs such as secretarial chairs, it will be quite obvious that the mounting and adjustment assembly 3 of the present invention may be used in combination with other body support or rest members such as a head rest as provided on barber's or dentist's chairs. The assembly 3 not only provides the means for rigidly mounting or attaching the rest member 1 to the support member 2, but also includes means allowing of the vertical adjustment of the rest member relative the support member. This mounting and adjustment assembly 3 is preferably attached to the rear face 1*a* of the rest member 1 and includes a housing 4 comprising a hat-shaped member having the medial section 5 parallel with and connected to a pair of lateral mounting flanges 6—6 by means of the side walls 7—7 which are perpendicular to the medial section and flanges. The vertical channel 8 thus defined by the inner surface 9 of the medial section 5 and the two shoulders defined by the parallel and opposed side walls 7—7 is intended to contain the working components of the subject adjustment mechanism. These components include a lever retainer plate generally designated 10 and serving as attachment means, the length and width of which does not exceed the corresponding dimensions of the vertical channel 8 or inner surface 9 of the housing 4. This retainer plate 10 is intended to remain a fixed component within the mounting and adjustment assembly 3 and accordingly suitable means (not shown) are provided to insure its retention within the channel 8 with its rear face 10*a* juxtaposed the inner surface 9 of the housing. This retention may be achieved by any of various means such as spot welding, adhesive, by clinching to restrain by a press fit within the channel 8 or the retaining of plate 10 can be accomplished by providing embossments to frictionally preclude displacement thereof. The depth of the channel 8 as provided by the dimension of the side walls 7 is substantially greater than the thickness of the planar retainer plate 10 for reasons which will become obvious hereinafter.

A cutout, generally designated 11, is formed in the retainer plate 10 and its construction and function will be shortly described in greater detail. Slideably disposed within the balance of the depth of the vertical channel 8 is the upper portion of the back post 2. The width of the back post 2 is selected to insure uninhibited vertical sliding displacement of the back post 2 relative the channel 8 without any binding between the post edges 2*a* and the shoulders of the channel as provided by the side walls 7—7 thereof. The thickness of the planar post 2 and the retainer plate 10 when combined will be understood to be readily accepted within the thickness of the vertical channel 8 and the retainer plate and back post are both disposed within the channel with the rear face 2*b* of the back post juxtaposed the front face 10*b* of the retainer plate. The front face 2*c* of the back post will not project beyond the plane of the parallel inner faces 6*a*—6*a* of the housing flanges 6—6, thereby insuring uninhibited vertical displacement between the housing 4 and its attached retainer plate 10 and the back post 2.

The housing 4 may be enclosed on its front side by means of the backing plate 12, comprising a planar plate including a plurality of holes 13 registering with a similar number of holes 14 formed in the two mounting flanges 6 of the housing 4. The holes 13 are provided with embossments 13' juxtaposed the housing flanges 6 and which serve to positively locate the housing 4 and retain its exact size when assembled and during use of the backrest. Suitable fasteners 15, such as rivets, serve to join the backing plate 12 to the housing 4 and it will be obvious that these same fasteners 15 may likewise be utilized to attach the mounting and adjustment assembly 3 to the rest member 1, in which case they may then, of course, be disposed through at least a portion of the body of the rest member 1 before passing through the backing plate 12 and housing 4. Depending upon the construction of any specific rest member 1, namely its contour and the material forming the rear face 1*a* thereof, the use of the backing plate 12 immediately adjacent the rear face 1*a* may be optional since the surface of the rear face 1*a* itself may serve the same function as the backing plate 12 if at least the control portion of the rear face 1*a* is planar and smooth.

The adjustable locking capability of the mounting and adjustment assembly 3 of the present invention is provided by actuating means comprising the actuating lever, generally designated 16, which will be seen to comprise a substantially planar element adapted to be contained within the cutout 11 of the retainer plate 10. This actuating lever 16 includes a circular bearing portion 17 provided with oppositely disposed arcuate peripheral bearing surfaces 18—18 from which extend upwardly a lock tab 19 having catch means comprising a forwardly offset catch 20. Diametrically disposed from the lock tab 19 is an arm 21 projecting downwardly from the circular bearing portion 17 and terminating in a distal rearwardly projecting offset finger portion 22. With the exception of the forwardly offset catch 20 and rearwardly projecting finger 22, the body of the actuating lever 16 is planar and its thickness is no greater than the thickness of the retainer plate 10 for reasons which will become obvious hereinafter. As previously described, the actuating lever 16 is disposed within the retainer plate cutout 11, which cutout includes an arcuate pivot bearing section 23 including a pair of oppositely disposed arcuate bearing segments 24—24 corresponding in curvature to the arcuate peripheral bearing surfaces 18—18 of the actuating lever bearing portion 17. The pivot bearing section 23 of the cutout 11 communicates with the lock tab section 25, which is large enough to accommodate the lever lock tab 19, while this lock tab section 25 further communicates with the uppermost lateral spring section 26. The lower portion of the pivot bearing section 23 of the cutout 11 in turn communicates downwardly with a lower arm section 27, which cutout section passes through the bottom edge 28 of the retainer plate 10.

Figure 3:
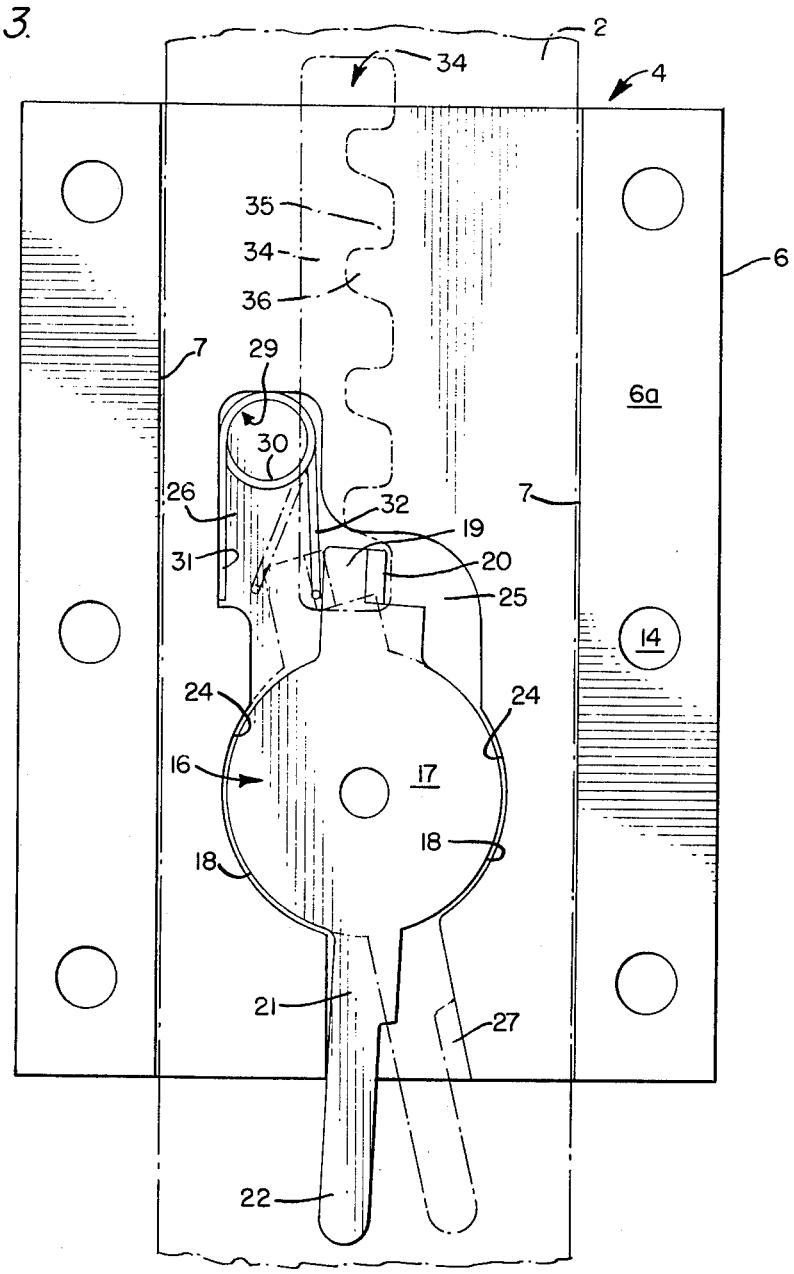
FIG. 3 is an enlarged front elevation of the components of FIG. 2 illustrated in the assembled condition.

The relationship of the various sections of the cutout 11 as described above to the numerous components of the mounting and adjustment assembly will be most readily appreciated from a review of FIG. 3 of the drawings, wherein it will be seen that with the actuating lever 16 disposed within the cutout 11 the circular bearing portion 17 of the lever is, in effect, journalled within the pivot bearing section 23 with a close rotary fit being provided by its arcuate peripheral bearing surfaces 18—18 and the mating surfaces as formed by the arcuate bearing segments 24—24 of the retainer plate. In this figure the actuating lever 16 is shown in full lines as it appears when in its normal or at-rest position. This position is insured by means of a compression spring 29 having a thickness which is no greater than that of the retainer plate 10 and which is disposed within the upper lateral spring section 26 of the cutout 11. The spring 29 preferably includes a spring coil 30 nested within the upper portion of the spring cutout section 26 and from which depends a base leg 31 and a compression leg 32, the latter of which constantly bears against the upwardly projecting lock tab 19 of the lever 16.

As previously described, the actuating lever 16 includes a single forwardly projecting portion, namely the offset catch 20, which projects from the lock tab 19 and thus extends forwardly from the plane of the retainer front face 10*b* and into the plane of the body of the back post 2. This catch 20 is adapted to cooperate with structure in the upper portion of the back post 2 comprising a lock cutout generally designated 33, which cutout will be seen to include a vertical channel 34 communicating with lock means comprising a plurality of laterally extending lock recesses 35 defined by the intermediate projections 36. The height of each of the lock recesses 35 between each pair of adjacent projections 36 will be seen to be sufficient to allow entry of the offset catch 20 of the actuating lever when this lever is pivoted clockwise, as viewed in FIG. 3 of the drawings, to the locked position, as shown in full lines in this figure. With the foregoing in mind it will now be readily understood that when the vertical adjustment of the rest member 1 is desired it is only necessary to laterally or arcuately displace the arm 21 of the actuating lever such that the lever is pivoted about its circular bearing portion 17 to cause the lock tab 19 to move counter-clockwise toward the broken line position of FIG. 3, thereby simultaneously displacing the offset catch 20 from its former disposition within one of the lock recesses 35 to a position within the vertical channel 34 of the back post 2. With the actuating lever 16 thus disposed against the force of the compression spring 29, the rest member 1 is merely elevated or lowered as desired until the selected elevation is achieved, whereupon the arm 21 of the lever is released, thus permitting the spring 29 to return the lock tab 19 and its catch 20 towards the adjacent recess 35 thereby fixedly securing the backrest to the back post 2.

Figure 2:
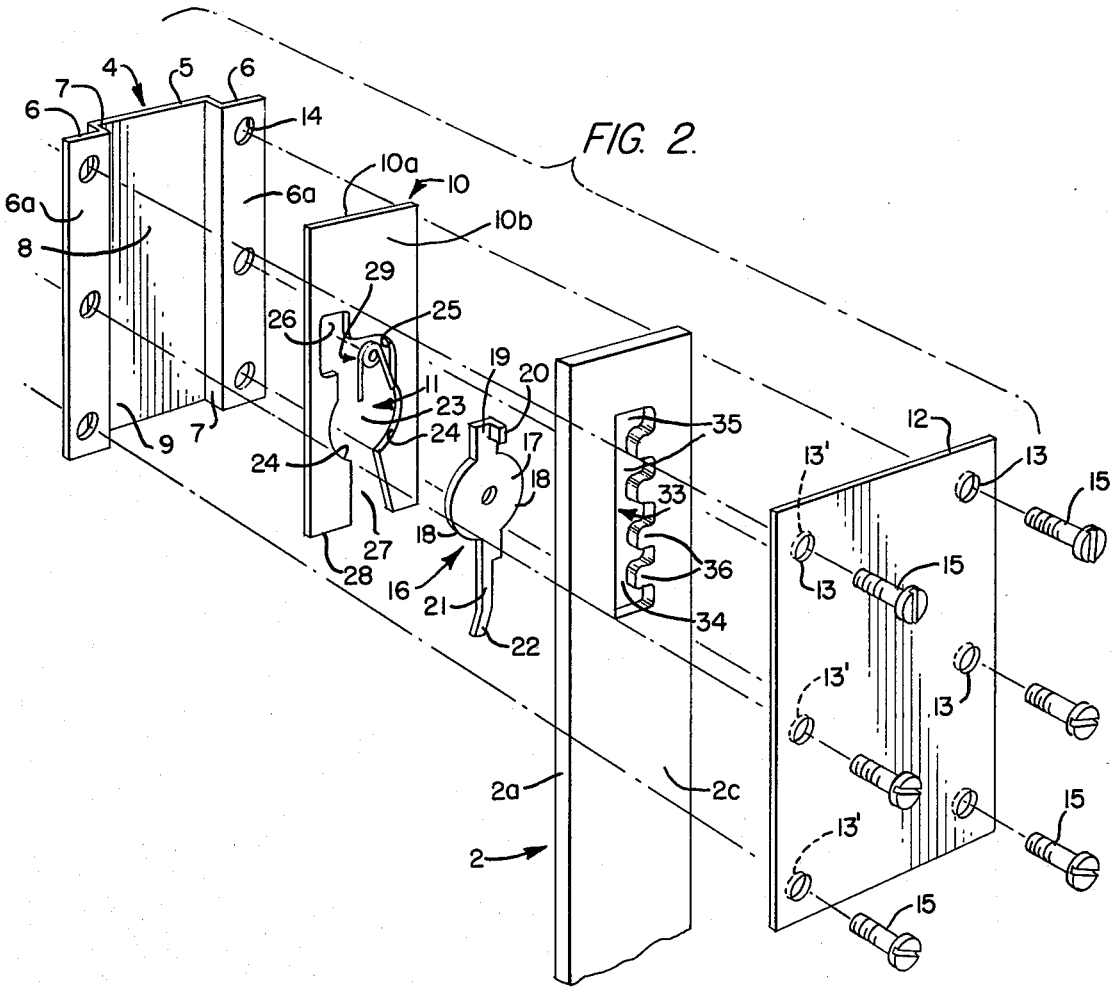
FIG. 2 is an exploded top perspective view of the adjustment mechanism of FIG. 1.
Figure 4:
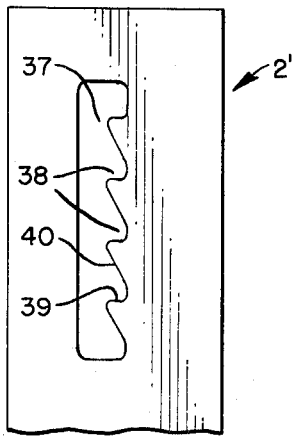
FIG. 4 is a fragmentary front elevation illustrating a modification of the upright support member.

With the construction of the lock cutout 33 as shown in FIGS. 2 and 3 of the drawings it will be observed that it is necessary to arcuately or laterally displace the actuating lever 16 as above described before the rest member 1 can be either raised or lowered since the offset catch 20 is normally spring-urged into a positive locking engagement between a pair of substantially horizontally extending projections 36—36. As an alternative, the lock cutout 37 as shown in the embodiment of FIG. 4 may be employed, wherein it will be seen that each of the recesses 38 is bounded by a substantially horizontal lower surface 39 and an upwardly inclined upper surface 40. With this latter arrangement, it will be obvious that to elevate a rest member incorporating the back post 2' it would not be necessary to manually displace the actuating lever 16 since the force of elevating the rest member itself would cause the lever offset catch 20 to be automatically cammed in a counter-clockwise direction out of the recess 38 by the inclined upper surface 40, and to subsequently be spring-urged back into the next succeeding recess 38. It would, of course, still be necessary to manually displace the actuating lever when it is desired to lower a back rest member incorporating the cutout 37 of the back post 2'.

I claim:

1. A mounting and adjustment assembly for attaching a rest member to an upright post member including, a housing secured to said rest member, said housing provided with a vertical channel juxtaposed said rest member, said post member slideably disposed within said channel, displaceable actuating means disposed within said housing channel, said actuating means provided with catch means, attachment means within said housing channel securing said actuating means therein and allowing limited displacement thereof, said attachment means comprising a planar retainer plate fixedly disposed within said housing channel, said plate provided with a cutout including an arcuate bearing section, said actuating means comprising a lever having a planar circular bearing portion journalled within said plate bearing section, said lever catch means projecting from the plane of said circular bearing portion toward said post member lock means, a plurality of lock means on said post member, spring means normally urging said catch means to engage one said lock means to immobilize said rest member relative said post member and a finger portion on said lever accessible from outside said housing and manually operable to displace said catch means against the force of said spring means to disengage said catch means from said post member lock means to allow vertical adjustment of said rest member relative said post member.

2. An assembly according to claim 1 wherein, said lock means comprises a cutout in said post member including a plurality of vertically disposed alternate projections and recesses all communicating with an adjacent vertical channel and the height of each said recess is no less than the height of said lever catch means.

3. An assembly according to claim 1 including, a planar backing plate between said housing and rest member and enclosing said retainer plate, lever and post member within said channel.

4. An assembly according to claim 3 including, fastener means securing said housing to said backing plate and rest member.

5. A mounting and adjustment assembly for attaching a rest member to an upright post member including, a housing secured to said rest member, said housing provided with a vertical channel juxtaposed said rest member, said housing comprising a hat-shaped member including a medial section bounded by two perpendicular side walls each in turn joined to a mounting flange parallel to said medial section, said vertical channel defined by said medial section and two side walls, said post member slideably disposed within said channel, displaceable actuating means disposed within said housing channel, said actuating means provided with catch means, a planar retainer plate fixed within said housing channel juxtaposed said medial section, said retainer plate provided with a cutout, said actuating means comprising a lever journalled within said cutout for pivotal displacement, a plurality of lock means on said post member, spring means normally urging said catch means to engage one said lock means to immobilize said rest member relative said post member, said spring means disposed within said cutout, said plate and post member having a combined thickness no greater than the depth of said channel, and a finger portion on said actuating means accessible from outside said housing and manually operable to displace said catch means against the force of said spring means to disengage said catch means from said post member lock means to allow vertical adjustment of said rest member relative said post member.

6. An assembly according to claim 5 wherein, said catch means include an offset catch projecting from said lever to said post member and said lock means includes a cutout in said post member defining a plurality of vertically disposed alternate projections and recesses.

7. An assembly according to claim 6 wherein, each said projection is substantially horizontally disposed.

8. An assembly according to claim 6 wherein, each said recess is bounded by a lower horizontal surface and an upper inclined surface.

9. An assembly according to claim 5 wherein, said lock means comprises a cutout in said post member including a plurality of vertically disposed alternate projections and recesses all communicating with an adjacent vertical channel and the height of each said recess is no less than the height of said lever catch means.

* * * * *